US009004380B2

(12) United States Patent
Qi et al.

(10) Patent No.: US 9,004,380 B2
(45) Date of Patent: Apr. 14, 2015

(54) SHOWER HEAD

(71) Applicants: Yaoting Qi, Xiamen (CN); Jianliang Dai, Xiamen (CN); Guangyi Zeng, Xiamen (CN)

(72) Inventors: Yaoting Qi, Xiamen (CN); Jianliang Dai, Xiamen (CN); Guangyi Zeng, Xiamen (CN)

(73) Assignee: Xiamen FXY Bathroom Products Co., Ltd., Xiamen, Fujian (CN)

( * ) Notice: Subject to any disclaimer, the term of this patent is extended or adjusted under 35 U.S.C. 154(b) by 148 days.

(21) Appl. No.: 13/863,033

(22) Filed: Apr. 15, 2013

(65) Prior Publication Data

US 2014/0306033 A1 Oct. 16, 2014

(51) Int. Cl.
*B05B 1/18* (2006.01)
*B05B 7/04* (2006.01)

(52) U.S. Cl.
CPC ..... *B05B 1/18* (2013.01); *B05B 7/0425* (2013.01)

(58) Field of Classification Search
CPC ..... E05B 1/18; E05B 1/185; E05B 7/0425; E03C 1/0409
USPC ..... 239/428.5, 432, 525, 548, 554–561, 239/567, 596, 600
See application file for complete search history.

(56) References Cited

U.S. PATENT DOCUMENTS

| | | | | |
|---|---|---|---|---|
| 2005/0284967 | A1* | 12/2005 | Korb et al. | 239/552 |
| 2006/0102747 | A1* | 5/2006 | Ho | 239/383 |
| 2006/0163391 | A1* | 7/2006 | Schorn | 239/596 |
| 2008/0011880 | A1* | 1/2008 | Butzke et al. | 239/428.5 |
| 2011/0297759 | A1* | 12/2011 | Morbio | 239/428.5 |
| 2013/0119160 | A1* | 5/2013 | Yu | 239/532 |

* cited by examiner

*Primary Examiner* — Darren W Gorman

(57) ABSTRACT

A shower head includes a shower head body, a water diversion plate with water diversion outlets, a water outflow member with nozzles, and a water outlet panel with water outlets. The nozzles of the water outflow member extend out of the respective water outlets of the water outlet panel. A gap is defined between each nozzle of the water outflow member and each water outlet of the water outlet panel. A water mix mechanism is provided between the water outflow member and the water diversion plate. The water mix mechanism is that the water outflow member has an air inlet and that the water diversion plate is formed with a water diversion lid at a lower surface thereof to cover the exterior of the air inlet. The water diversion outlets of the water diversion plate are aligned with the position between the air inlet and the water diversion lid.

6 Claims, 5 Drawing Sheets

SHOWER HEAD

BACKGROUND OF THE INVENTION

1. Field of the Invention

The present invention relates to a spray device for a shower bath, and more particularly to a shower head which is able to mix the air and water to spray soft bubble water.

2. Description of the Prior Art

An improved shower head provides bubble water by mixing the air with water during spraying water. Because the water contains a certain amount of air, the user will feel soft and comfortable when taking a bath. This has a water-saving effect instead of the traditional water mode to spray water direct.

However, the air inlet hole of the shower head is disposed at the handle of the shower head. When the water pressure is lower, the water will flow back. The air inlet hole of the handle may have a leak of water.

SUMMARY OF THE INVENTION

The primary object of the present invention is to provide a shower head which is able to mix the air and water adequately, not influenced by the water pressure.

In order to achieve the aforesaid object, the shower head of the present invention comprises a shower head body, a water diversion plate with water diversion outlets, a water outflow member with nozzles, and a water outlet panel with water outlets. The circumferential edges of the water diversion plate and the shower head body are sealed to form a water inflow chamber therebetween. The water outflow member is disposed in front of the water diversion plate. The circumferential edges of the water outflow member and the water diversion plate are mated with each other to form a water outflow chamber therebetween. The water outlet panel is to cover a front end of the shower head body. The nozzles of the water outflow member extend out of the respective water outlets of the water outlet panel. A gap is defined between each nozzle of the water outflow member and each water outlet of the water outlet panel. A water mix mechanism is provided between the water outflow member and the water diversion plate. The water mix mechanism is that the water outflow member has an air inlet and that the water diversion plate is formed with a water diversion lid at a lower surface thereof to cover the exterior of the air inlet. The water diversion outlets of the water diversion plate are aligned with the position between the air inlet and the water diversion lid.

Preferably, the water outflow member has an annular flange at a rear end of the air inlet, and the water diversion lid is to cover the exterior of the annular flange.

Preferably, the water diversion plate has a plurality of spray nets at a lower end edge thereof, and the upper end of the annular flange is higher than the upper end edges of the spray nets.

Preferably, the lower surface of the water diversion plate, corresponding in position to the water diversion outlets, is concaved to form annular protruding walls, and the water outflow member has a plurality of holding posts corresponding to the protruding walls.

The present invention provides the water mix mechanism disposed between the water diversion plate and the water outflow member. That is, the air inlet of the water outflow member is covered with the water diversion lid. The water diversion outlets are aligned with the position between the air inlet and the water diversion lid. When high-speed water enters from the water diversion outlets, the negative pressure chamber is formed above the air inlet. The air enters the negative pressure chamber through the gaps between the nozzles and the water outlets to mix with the water, and then the bubble water sprays from the nozzles. The present invention has a simple structure and provides better bubble water containing oxygen. The air inlet is disposed in a hidden way, and the water won't flow back subject to water pressure.

DETAILED DESCRIPTION OF THE PREFERRED EMBODIMENTS

Embodiments of the present invention will now be described, by way of example only, with reference to the accompanying drawings.

Figure 1:
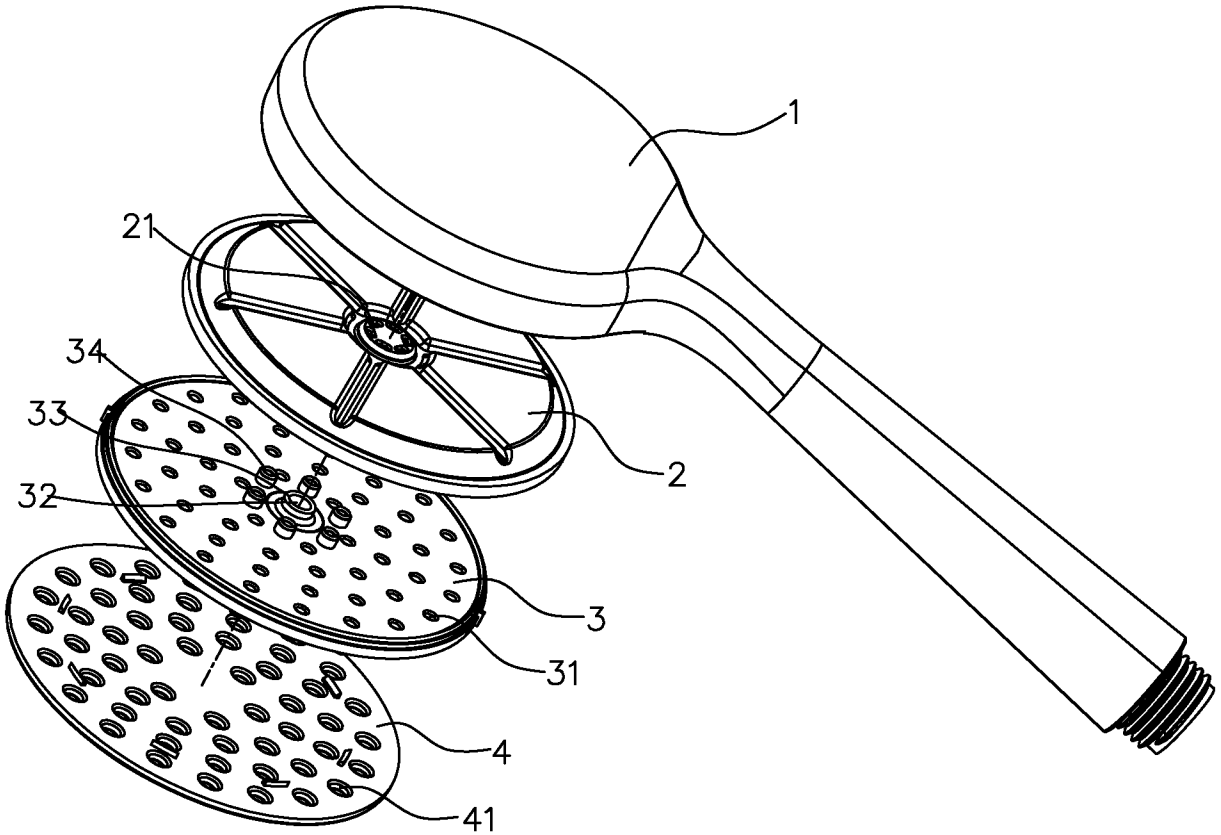
FIG. 1 is an exploded view of the present invention.
Figure 1A:
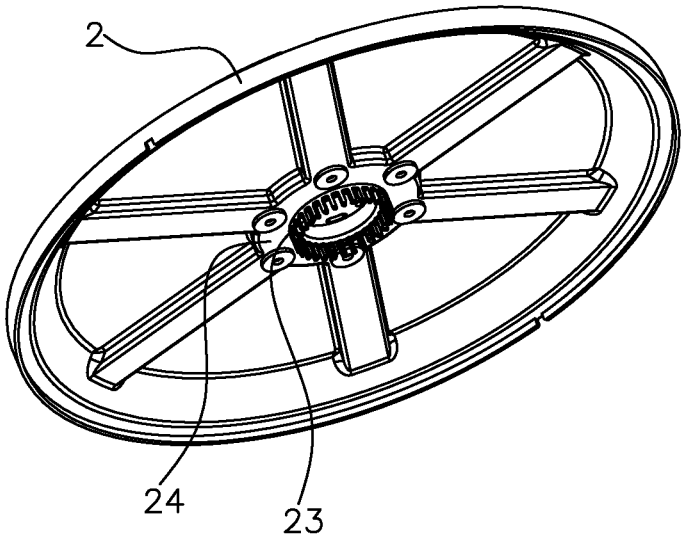
FIG. 1A is a perspective view showing the water diversion plate of the present invention.
Figure 1B:
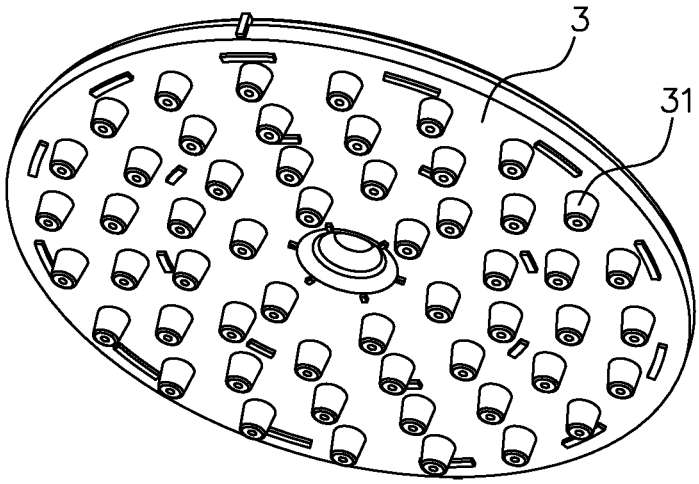
FIG. 1B is a perspective view showing the water outflow member of the present invention.
Figure 2:
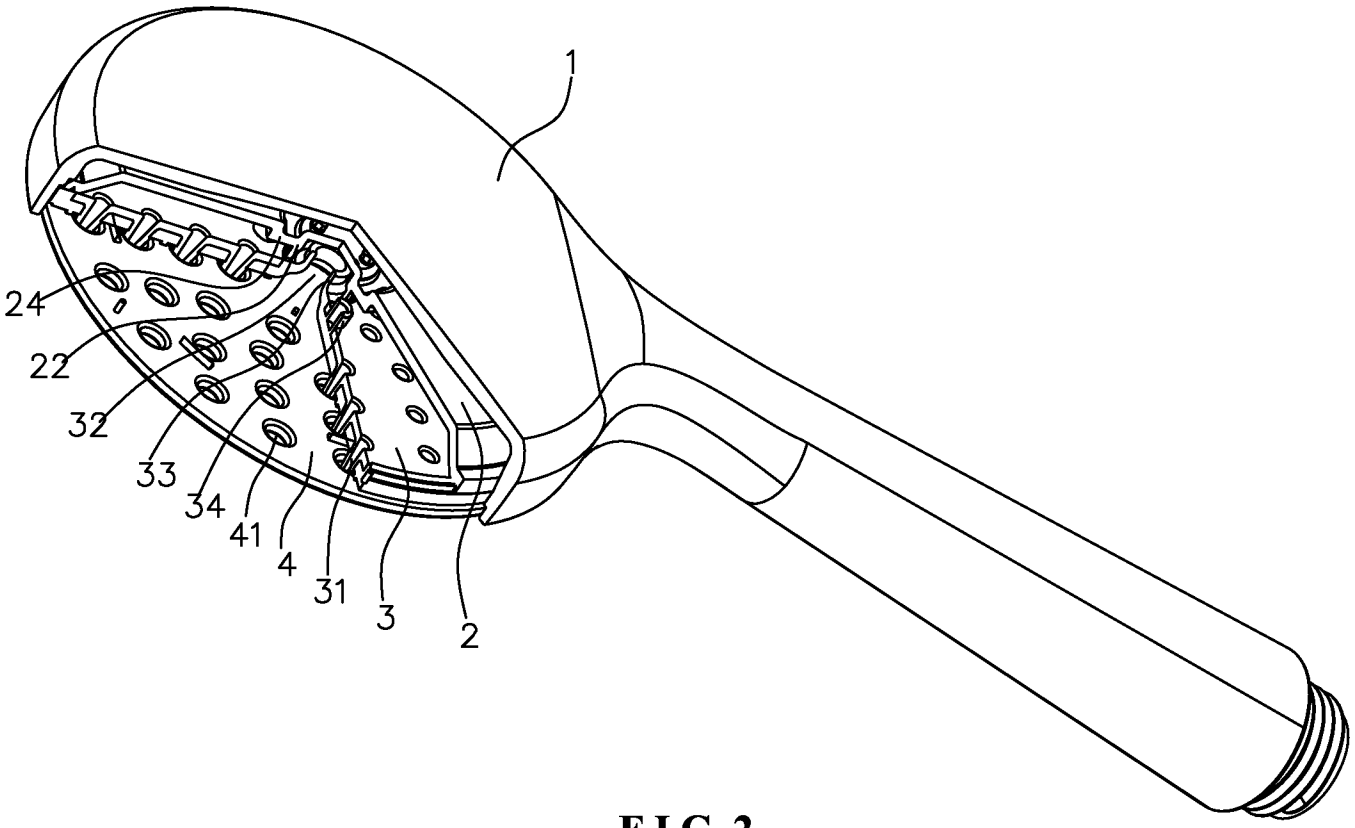
FIG. 2 is a perspective partial sectional view showing the water diversion plate of the present invention.
Figure 3:
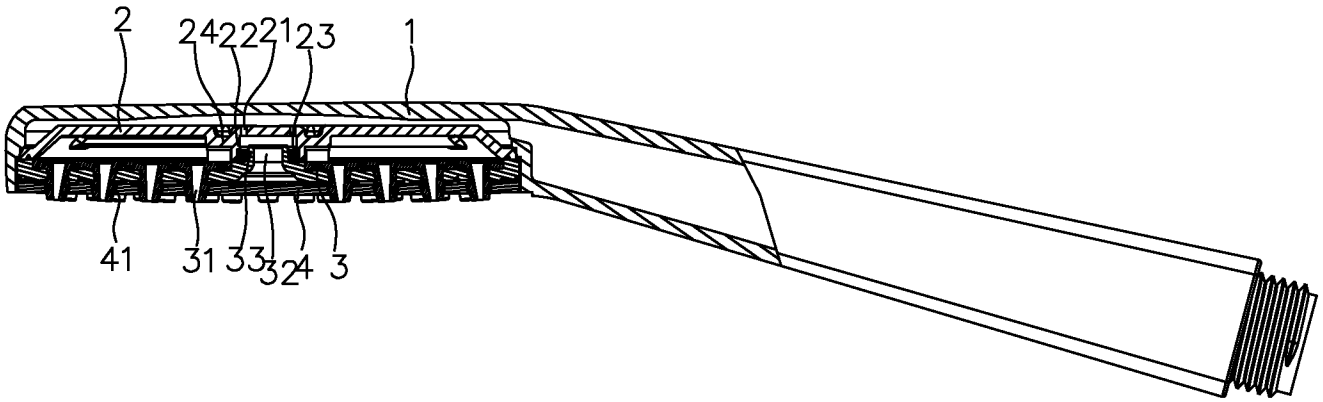
FIG. 3 is a sectional view of the present invention.
Figure 3A:
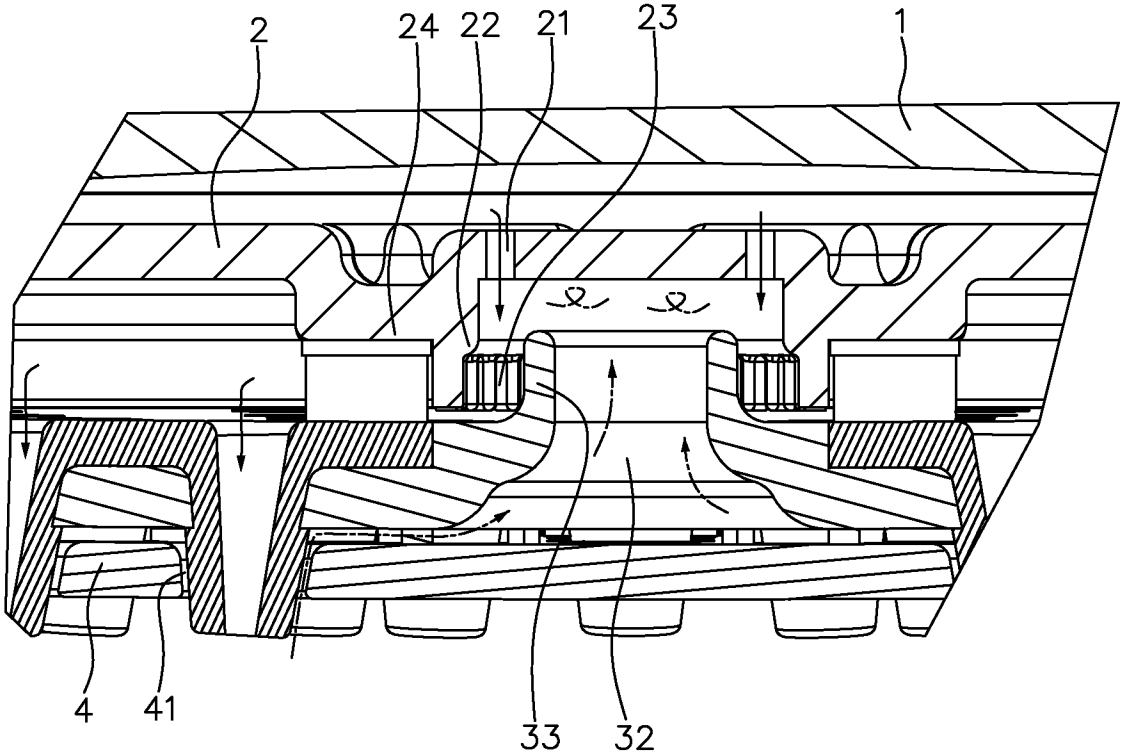
FIG. 3A is an enlarged view of FIG. 3.

As shown in FIG. 1 to FIG. 3, the shower head of the present invention comprises a shower head body 1, a water diversion plate 2 with water diversion outlets 21, a water outflow member 3 with nozzles 31, and a water outlet panel 4 with water outlets 41. The circumferential edges of the water diversion plate 2 and the shower head body 1 are sealed to form a water inflow chamber therebetween. The water outflow member 3 is disposed in front of the water diversion plate 2. The circumferential edges of the water outflow member 3 and the water diversion plate 2 are mated with each other to form a water outflow chamber therebetween. The water outlet panel 4 is to cover a front end of the shower head body 1. The nozzles 31 of the water outflow member 3 extend out of the respective water outlets 41 of the water outlet panel 4.

A gap is defined between each nozzle 31 of the water outflow member 3 and each water outlet 41 of the water outlet panel 4 to form an air inlet passage. A water mix mechanism is provided between the water outflow member 3 and the water diversion plate 2. In this embodiment, the water mix mechanism is disposed between the center of the water outflow member 3 and the water diversion plate 2. The water outflow member 3 has an air inlet 32 at a central portion thereof and an annular flange 33 at a rear end of the air inlet 32. The water diversion plate 2 is formed with a water diversion lid 22 at a lower surface thereof corresponding to the annular flange 33 so as to cover the exterior of the annular flange 33. The water diversion outlets 21 of the water diversion plate 2 are disposed between the gap of the annular flange 33 and the water diversion plate 2. The water diversion plate 2 has a plurality of lateral spray nets 23 at a lower end edge thereof. When the water diversion lid 22 and the annular flange 33 are mated, the upper end of the annular flange 33 is higher than the upper end edges of the spray nets 23. For the water to flow out through the water diversion outlets 21, the lower surface of the water diversion plate 2, corresponding in position to the water diversion outlets 21, is concaved to form annular protruding walls 24. The water outflow member 3 has a plurality of holding posts 34 corresponding to the protruding walls 24.

When in use, the shower head is turned on to communicate with the water source. The water enters the water inflow chamber of the shower head and flows to the gap between the annular flange 33 and the water diversion lid 22 through the water diversion outlets 21 of the water diversion plate 2. According to Venturi principle, a negative pressure chamber is formed between the upper portion of the annular flange 33 and the water diversion lid 22, so the air will flow through the gaps between the nozzles 31 and the water outlets 41 along the air inlet 32 to enter the negative pressure chamber to mix with the water to form bubble water containing oxygen. The water mixed with oxygen flows through the spray nets 23 to be further distributed, and then enters the water outflow chamber to spray through the nozzles 31 of the water outflow member 3, providing soft and comfortable bubble water.

The present invention provides the water mix mechanism disposed between the water diversion plate 2 and the water outflow member 3. That is, the air inlet 32 of the water outflow member 3 is covered with the water diversion lid 22. The water diversion outlets 21 are aligned with the position between the air inlet 32 and the water diversion lid 22. When high-speed water enters from the water diversion outlets 21, the negative pressure chamber is formed above the air inlet 32. The air enters the negative pressure chamber through the gaps between the nozzles 31 and the water outlets 41 to mix with the water, and then the bubble water sprays from the nozzles 31. The present invention has a simple structure and provides better bubble water containing oxygen. The air inlet is disposed in a hidden way, and the water won't flow back subject to water pressure.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A shower head, comprising a shower head body, a water diversion plate with water diversion outlets, a water outflow member with nozzles, and a water outlet panel with water outlets; circumferential edges of the water diversion plate and the shower head body being sealed to form a water inflow chamber therebetween, the water outflow member being disposed in front of the water diversion plate, circumferential edges of the water outflow member and the water diversion plate being mated with each other to form a water outflow chamber therebetween, the water outlet panel being to cover a front end of the shower head body, the nozzles of the water outflow member extending out of the respective water outlets of the water outlet panel; a gap being defined between each nozzle of the water outflow member and each water outlet of the water outlet panel, a water mix mechanism being provided between the water outflow member and the water diversion plate, the water mix mechanism being that the water outflow member has an air inlet and that the water diversion plate is formed with a water diversion lid at a lower surface thereof to cover an exterior of the air inlet; the water diversion outlets of the water diversion plate being aligned between the air inlet and the water diversion lid.

2. The shower head as claimed in claim 1, wherein the water diversion plate has a plurality of spray nets at a lower end edge thereof, and the water outflow member has an annular flange at a rear end of the air inlet, wherein an upper end of the annular flange is higher than upper end edges of the spray nets.

3. The shower head as claimed in claim 2, wherein the lower surface of the water diversion plate, corresponding in position to the water diversion outlets, is concaved to form annular protruding walls, and the water outflow member has a plurality of holding posts corresponding to the protruding walls.

4. The shower head as claimed in claim 1, wherein the water outflow member has an annular flange at a rear end of the air inlet, and the water diversion lid is to cover an exterior of the annular flange.

5. The shower head as claimed in claim 4, wherein the water diversion plate has a plurality of spray nets at a lower end edge thereof, and an upper end of the annular flange is higher than upper end edges of the spray nets.

6. The shower head as claimed in claim 5, wherein the lower surface of the water diversion plate, corresponding in position to the water diversion outlets, is concaved to form annular protruding walls, and the water outflow member has a plurality of holding posts corresponding to the protruding walls.

* * * * *